US007237880B2

(12) United States Patent
Miyazawa et al.

(10) Patent No.: US 7,237,880 B2
(45) Date of Patent: Jul. 3, 2007

(54) LIQUID CONTAINING BAG AND LIQUID EJECTOR

(75) Inventors: Yoshio Miyazawa, Nagano (JP); Masanori Kobayashi, Nagano (JP); Masahiro Nakamura, Nagano (JP); Seiji Mochizuki, Nagano (JP); Kazuo Koshino, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 279 days.

(21) Appl. No.: 10/523,759

(22) PCT Filed: Oct. 23, 2003

(86) PCT No.: PCT/JP03/13580

§ 371 (c)(1),
(2), (4) Date: Feb. 8, 2005

(87) PCT Pub. No.: WO2004/037541

PCT Pub. Date: May 6, 2004

(65) Prior Publication Data

US 2005/0243148 A1 Nov. 3, 2005

(30) Foreign Application Priority Data

Oct. 23, 2002 (JP) ..... 2002-308311

(51) Int. Cl.
*B41J 2/175* (2006.01)

(52) U.S. Cl. ..... 347/86

(58) Field of Classification Search ..... 347/7, 347/19, 85, 86, 87; 455/73, 575.1; 399/12, 399/24

See application file for complete search history.

(56) References Cited

U.S. PATENT DOCUMENTS 6,130,695 A * 10/2000 Childers et al. ..... 347/85
6,834,945 B2 * 12/2004 Ishizawa et al. ..... 347/86
6,938,976 B2 * 9/2005 Siwinski et al. ..... 347/19
7,048,348 B2 * 5/2006 Mochizuki et al. ..... 347/7
2002/0051021 A1 5/2002 Mochizuki et al.
2003/0071874 A1 4/2003 Ishizawa et al.

FOREIGN PATENT DOCUMENTS

EP 1 199 177 A1 4/2002

FOREIGN PATENT DOCUMENTS

JP 2002-120382 A 4/2002
JP 2002-192752 A 7/2002
WO 01/53104 A1 7/2001

OTHER PUBLICATIONS

Form PCT/ISA/210 (International Search Report with 4 cited references) from PCT/JP03/13580, dated Jan. 13, 2004.

* cited by examiner

*Primary Examiner*—Anh T. N. Vo
(74) *Attorney, Agent, or Firm*—Stroock & Stroock & Lavan LLP

(57) ABSTRACT

It is an object to provide a liquid storage bag and a liquid ejection apparatus for accurately setting the relative position between storage means of data of the liquid consumption amount, etc., and a data transfer section. A flexible bag main body 2 is provided with a liquid supply port 4, storage means 17 for storing data of the liquid type, the storage capacity, the consumption amount, etc., is provided in a part of the bag main body 2, an interface section 54 for making it possible to transfer data between a data transfer section 34 placed in a part of a case 5 or an apparatus main unit 12 and the storage means 17 is attached to a part of the bag main body 2, and position correction means 43 capable of correcting the position of the interface section 54 is provided. In doing so, the position of the interface section 54 relative to the data transfer section 34 is adjusted with the bag main body 2 housed in the case 5, and data transfer in the data transfer section 34 is established precisely.

16 Claims, 10 Drawing Sheets

LIQUID CONTAINING BAG AND LIQUID EJECTOR

TECHNICAL FILED

This invention relates to a liquid storage bag used with a liquid ejection apparatus and a liquid ejection apparatus for ejecting liquid from the liquid storage bag.

BACKGROUND ART

As liquid storage vessels for liquid ejection apparatus for ejecting liquid through nozzle openings, those aiming at various liquids are known, among which an ink storage bag placed in an ink jet record apparatus can be named as a representative. Then, a related art will be discussed by taking the ink jet record apparatus as an example.

An ink storage bag in the related art is as follows: The ink storage bag is made of a flexible sheet material and is housed in a cartridge case (hard case) and this cartridge case is placed in the apparatus main unit, whereby ink in the ink storage bag is supplied to a print head of the apparatus main unit, as disclosed in JP-A-2002-192752. A noncontact memory IC for storing ink attribute data is attached to a part of the ink storage bag, and a data transfer section for transferring the data in the memory IC is provided in a part of a guide plate of the cartridge case.

Since the ink storage bag is made of a flexible sheet material, if the ink storage bag is entered in the cartridge case, it presents various shapes by the mass of the ink, an inertial force produced when the cartridge case is inserted into the apparatus main unit, etc. Therefore, the memory IC is inclined or is placed out of position and the appropriate relative position between the memory IC and the data transfer section becomes hard to set; there is a fear of hindering data read and write in some cases.

It is therefore an object of the invention to provide a liquid storage bag and a liquid ejection apparatus wherein when the liquid storage bag is housed in a cartridge case, the relative position between storage means of data of the liquid consumption amount, etc., placed in the liquid storage bag and a data transfer section can be set accurately.

DISCLOSURE OF THE INVENTION

To accomplish the object, according to the invention, there is provided a liquid storage bag wherein a flexible bag main body is provided with a liquid supply port and a cartridge case is placed in an apparatus main unit with the liquid storage bag housed in the cartridge case, whereby liquid in the bag main body is supplied through the liquid supply port to a liquid ejection head of the apparatus main unit, characterized in that storage means for storing data concerning liquid is provided in a part of the bag main body, that an interface section for making it possible to transfer data between a data transfer section placed in a part of the cartridge case or the apparatus main unit and the storage means is provided in a part of the bag main body, and that position correction means capable of correcting the position of the interface section to establish data transfer through the interface section with the bag main body housed in the cartridge case is provided.

That is, the storage means for storing data concerning liquid is provided in a part of the bag main body, the interface section for making it possible to transfer data between the data transfer section placed in a part of the cartridge case or the apparatus main unit and the storage means is provided in a part of the bag main body, and the position correction means capable of correcting the position of the interface section to establish data transfer through the interface section with the bag main body housed in the cartridge case is provided.

Thus, the interface section attached to a part of the bag main unit is placed in a state in which it can be displaced relatively to the bag main unit, and the position adjustment function based on the relative displacement is provided for making it possible to transfer data between the data transfer section and the storage means through the interface section. Therefore, even with the bag main body made of flexible sheet material high in deformability, the interface section can be moved to an appropriate position by the above-mentioned position correction means for setting the correct relative position between the interface section and the data transfer section. Accordingly, when the ink storage bag is entered in the cartridge case, immediately the relative position between the interface section and the data transfer section can be set, various pieces of data of the liquid consumption amount, etc., concerning the liquid attributes can be transferred reliably, and the function of the liquid storage bag can be provided precisely.

In the liquid storage bag of the invention, if the position correction means has a structure wherein an attachment member formed with the interface section is attached to a part of the bag main body and can be displaced relatively to the bag main body, the attachment member serves as a kind of medium member, namely, a base member between a part of the bag main body and the interface section and moreover can move relatively to the bag main body, so that a move of the interface section can be made smoothly based on the attachment member and the relative positional relationship between the interface section and the data transfer section can be set precisely.

In the liquid storage bag of the invention, if the attachment member is provided with a positioning part for setting the relative position between the cartridge case and the attachment member as the positioning part engages a part of the cartridge case, the relative position between the attachment member, namely, the interface section and the cartridge case, namely, the data transfer section is determined by the positioning part under the function of the position correction means, so that data transfer is executed precisely between the interface section and the data transfer section.

In the liquid storage bag of the invention, if the interface section is placed in the proximity of an end part of the bag main body, the interface section can be placed without hindering the liquid storage capacity of the bag main body; it is favorable to ensuring the liquid storage capability as the liquid storage bag. The data transfer section corresponding to the interface section can be placed to the end part of the cartridge case, so that the volume of the cartridge case can be provided large and the volume of the liquid storage bag can also be provided large.

In the liquid storage bag of the invention, if the interface section is placed in a hermetical seal superposition portion of above-mentioned sheet material forming the bag main body, the interface section is attached to the hermetical seal superposition portion having higher rigidity than the sheet material portion touching liquid, so that the attachment stability of the interface section can be enhanced as much as possible.

In the liquid storage bag of the invention, if the interface section is placed in the proximity of the liquid supply port, the ink supply port and the interface section can be placed collectively, so that the ink supply port, the interface section, and the like can be placed separately from the liquid storage capacity portion of the liquid storage bag and it is made possible to enlarge the liquid storage capacity as much as possible. Further, since making the ink supply port communicate with the liquid ejection head side and bringing the interface section into conduction with the data transfer section can be performed in a proximity state, when the cartridge case is mounted in an insertion mode, the ink communicating and data signal transfer described above can be performed at the back of the cartridge case and the organization of the cartridge case and the apparatus main unit is enhanced.

In the liquid storage bag of the invention, if the attachment member is made up of a first attachment member formed with the interface section and provided with the positioning part and a second attachment member passing through a through hole made in the hermetical seal superposition portion of the bag main body for attaching the first attachment member to the hermetical seal superposition portion and the thickness of a passage member of the second attachment member passing through the through hole is set smaller than the size of the through hole, the attachment member is made up of the first attachment member and the second attachment member as described above, so that the first and second attachment members are combined, whereby placement of the interface section and placement of the position correction means for making position adjustment of the interface section relative to the data transfer section can be realized at the same time and the attachment member goes to multifunctional according to the simple structure. To cause the position correction means to function, the relative position between the interface section and the bag main body can be adjusted based on the greater-than or less-than relationship between the passage member and the through hole, so that disorder of the position of the interface means caused by the flexibility of the bag main body or the like can be avoided.

In the liquid storage bag of the invention, if the interface section makes it possible to transfer data to and from the data transfer section by electric conduction, relative positioning between the contact placed in the interface section and the contact placed in the data transfer section is carried out reliably, the contacts are brought into contact with each other precisely, and reliable data transfer is realized.

In the liquid storage bag of the invention, if the interface section makes it possible to transfer data to and from the data transfer section in a noncontact manner, relative positioning between the antenna placed in the interface section and the antenna placed in the data transfer section is carried out reliably, the reception and transmission correspondence between the antennas is established precisely, and reliable data transfer is realized.

To accomplish the object, according to the invention, there is provided a liquid ejection apparatus including a liquid storage bag wherein a bag main body made of a flexible sheet material is provided with a liquid supply port and a cartridge case is placed in an apparatus main unit with the liquid storage bag housed in the cartridge case, whereby liquid in the bag main body is supplied through the liquid supply port to a liquid ejection head of the apparatus main unit, characterized in that storage means for storing data of the liquid type, the ink storage capacity, the liquid consumption amount, etc., is provided in a part of the bag main body, that an interface section for making it possible to transfer data between a data transfer section placed in a part of the cartridge case or the apparatus main unit and the storage means is attached to a part of the bag main body, and that position correction means capable of correcting the position of the interface section to establish data transfer through the interface section with the bag main body housed in the cartridge case is provided between the interface section and the bag main body, the liquid ejection apparatus for ejecting liquid supplied from the liquid storage bag through the liquid ejection head.

That is, in the liquid ejection apparatus of the invention, the storage means for storing data of the liquid type, the ink storage capacity, the liquid consumption amount, etc., is provided in a part of the bag main body, the interface section for making it possible to transfer data between the data transfer section placed in a part of the cartridge case or the apparatus main unit and the storage means is attached to a part of the bag main body, and the position correction means capable of correcting the position of the interface section to establish data transfer through the interface section with the bag main body housed in the cartridge case is provided between the interface section and the bag main body, the liquid ejection apparatus for ejecting liquid supplied from the liquid storage bag through the liquid ejection head.

Thus, the interface section attached to a part of the bag main unit is placed in a state in which it can be displaced relatively to the bag main unit, and the position adjustment function based on the relative displacement is provided for making it possible to transfer data between the data transfer section and the storage means through the interface section. Therefore, even with the bag main body made of flexible sheet material high in deformability, the interface section can be moved to an appropriate position by the above-mentioned position correction means for setting the correct relative position between the interface section and the data transfer section. Accordingly, when the ink storage bag is entered in the cartridge case, the relative position between the interface section and the data transfer section can be set, various pieces of data of the liquid consumption amount, etc., concerning the liquid attributes can be transferred reliably, and the function of the liquid ejection apparatus can be provided precisely.

In the liquid ejection apparatus of the invention, if a press member for maintaining the positioning state of the interface section and the data transfer section is provided, conductivity between the interface section and the data transfer section is always ensured normally, so that data transfer becomes reliable and the function as the highly reliable liquid storage bag can be provided.

In the liquid ejection apparatus of the invention, if the press member provides a press function in response to displacement when the cartridge case is placed in the apparatus main unit, placement of the cartridge case and the press function of the press member are executed automatically in conjunction with each other, so that the press member can be operated reliably and labor of the user can be lessened effectively.

In the liquid ejection apparatus of the invention, if the data transfer section is placed in the cartridge case, when the bag main body is housed in the cartridge case, immediately the interface section attached to the bag main body matches the data transfer section placed in the cartridge case, making possible data transfer. Thus, the ease of use of the cartridge case in the liquid ejection apparatus is enhanced.

To accomplish the object, according to the invention, there is provided a liquid storage bag for use with an liquid ejection apparatus, including a flexible bag main body for storing liquid, a liquid supply port for communicating with the inside of the bag main body, and storage means being formed in the bag main body for storing information concerning liquid, characterized by position correction means capable of moving the position of the interface section being connected to the storage means for transferring information to and from the liquid ejection apparatus in a predetermined range relative to the bag main body.

That is, the position correction means capable of correcting the position of the interface section being connected to the storage means for transferring information to and from the liquid ejection apparatus is provided. Thus, even with the flexible bag main body high in deformability, the interface section can be moved to an appropriate position by the above-mentioned position correction means for setting the correct position the interface section relative to the liquid ejection apparatus. Thus, the position of the interface section is corrected to an appropriate position in the liquid ejection apparatus, so that the information can be transferred accurately.

BEST MODE FOR CARRYING OUT THE INVENTION

The invention will be discussed in detail through embodiments of the invention. The invention is not limited to the embodiments thereof except as defined in the claims, and all of combinations of the features described in the embodiments are not necessarily indispensable for the solution means of the invention.

A liquid storage bag and a liquid ejection apparatus of the invention can be caused to function for various liquids that can be ejected by the liquid ejection apparatus. In the embodiments shown in the accompanying drawings, an application example of the liquid storage bag and the liquid ejection apparatus to an ink storage bag and an ink jet record apparatus is shown as a representative case.

Figure 1:
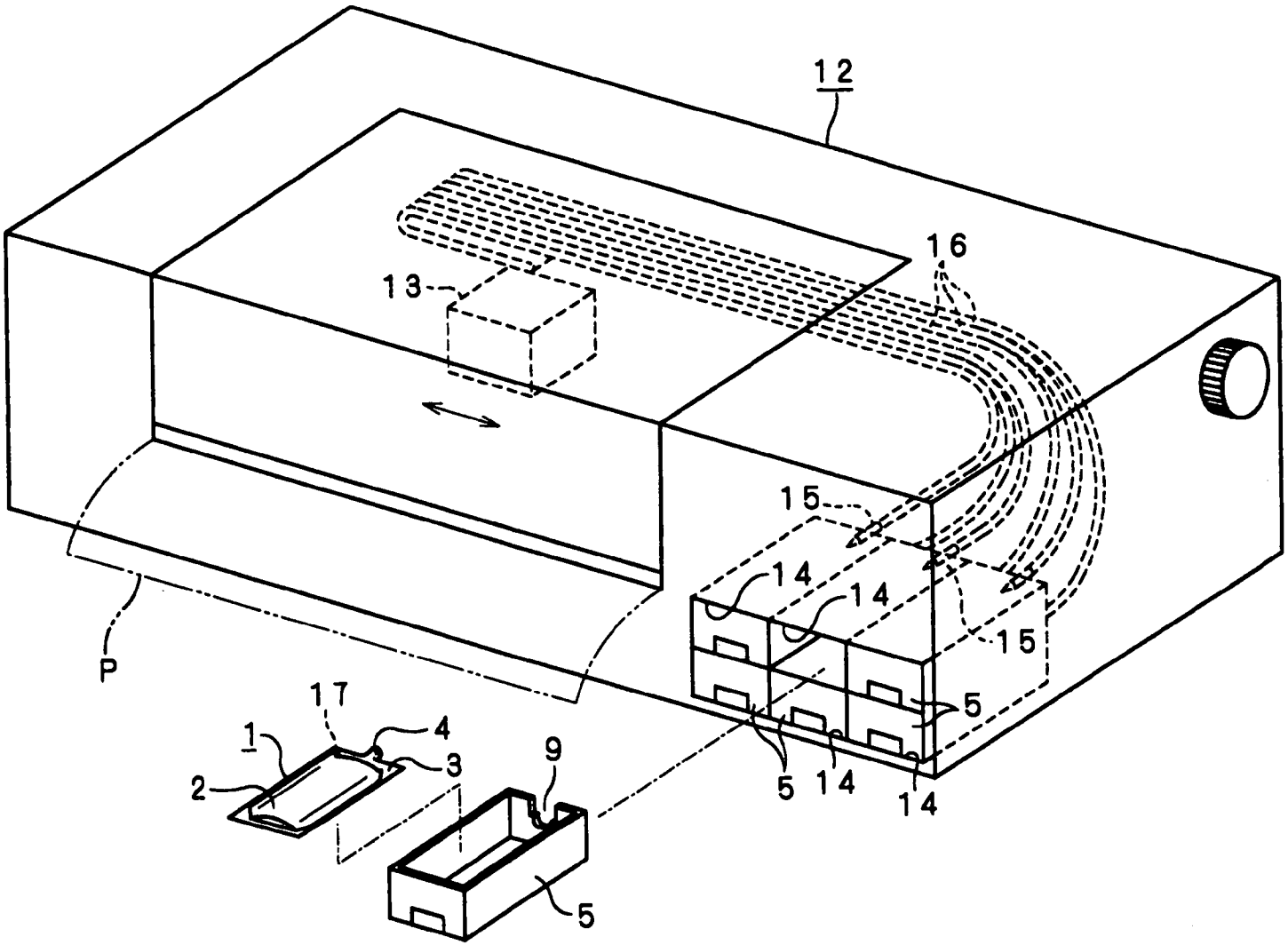
FIG. 1 is a perspective view to show an ink jet record apparatus of one embodiment of the invention.
Figure 2:
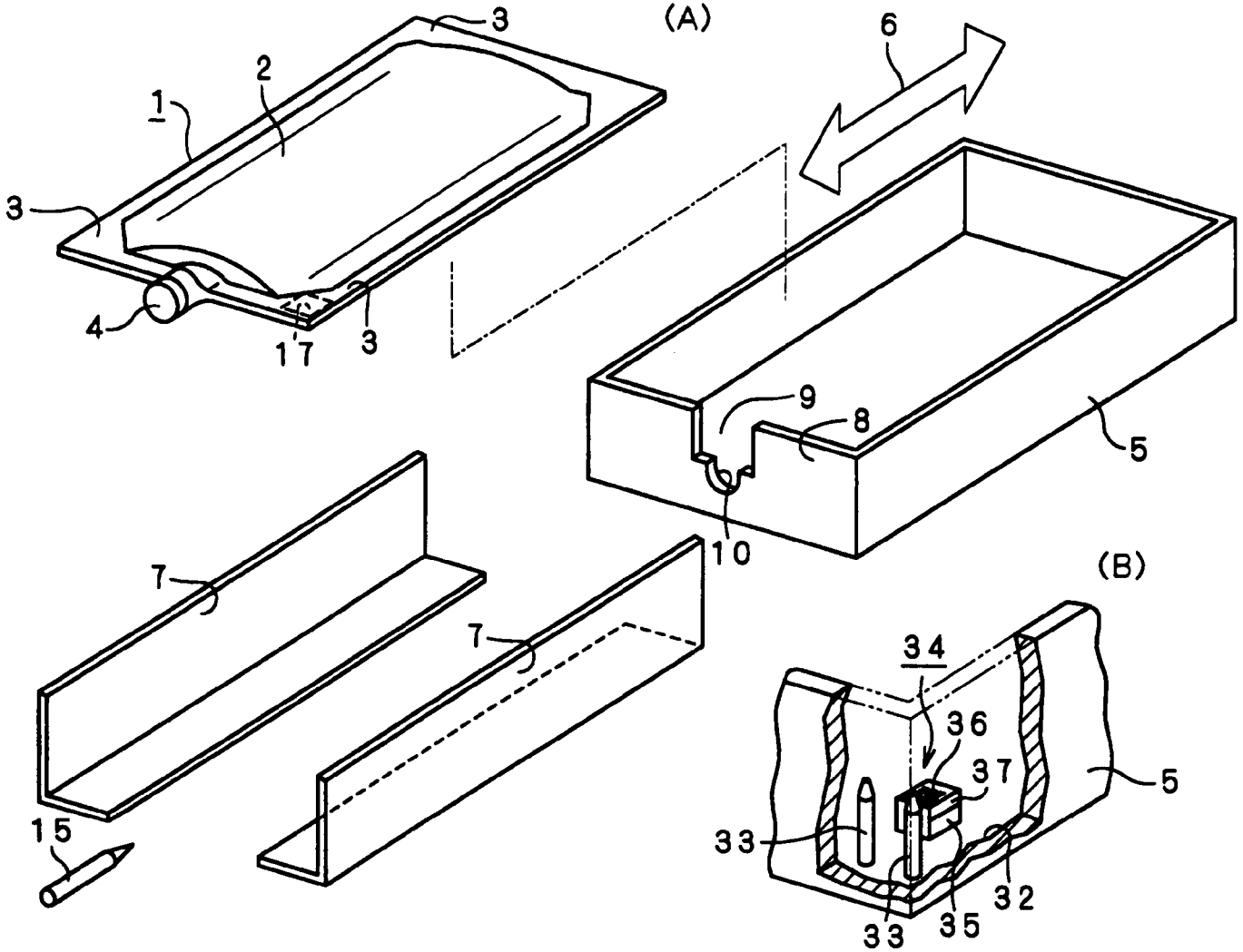
FIG. 2 is a perspective view to show a cartridge case and an ink storage bag as they are detached.

FIG. 1 shows one embodiment of the liquid ejection apparatus of the invention and represents the whole ink jet record apparatus of an apparatus main unit. FIG. 2 shows the associative structure of the ink storage bag of a liquid storage bag and a cartridge case.

A bag main body 2 of an ink storage bag 1 is a soft case provided by forming a flexible sheet material like a bag; for example, two sheet materials such as laminate films each having gas barrier properties provided by evaporating aluminum onto a polyethylene film are superposed on each other and thermal welding is conducted along the outer periphery of the superposed sheet material to provide hermetical seal superposition portion 3 and print ink is stored in the bag main body. An ink supply port 4 made of hard material such as a synthetic resin is thermally welded to one end margin of the bag main body 2, and ink in the bag main body 2 is taken out from the ink supply port 4.

Figure 6:
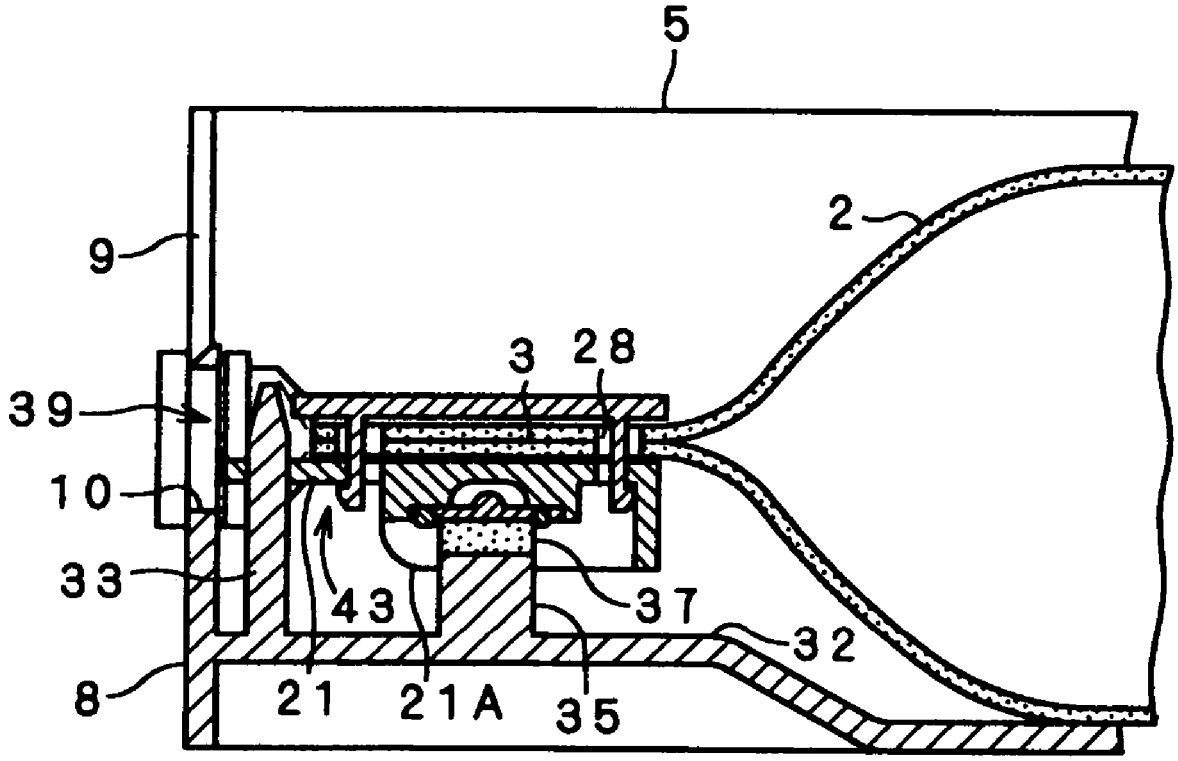
FIG. 6 is a sectional view to show a state in which the bag main body is placed in the cartridge case.

The ink storage bag 1 is housed in a box-like cartridge case 5 molded of a hard synthetic resin, etc. The cartridge case 5 is made to advance and retreat in the directions of an arrow 6 shown in FIG. 2, whereby it can be attached to and detached from an apparatus main unit described later. Guide members 7 and 7 for guiding the cartridge case 5 are fixed to the apparatus main unit. A back wall plate 8 in the insertion direction of the cartridge case 5 is formed with a notch part 9, and an engagement notch 10 cut like a circular arc is formed below the notch part. When the ink storage bag 1 is housed in the cartridge case 5, the engagement notch 10 is fitted into an annular groove 11 formed in the surroundings of the ink supply port 4 (see FIG. 3). This fitness state is shown in FIG. 6.

The above-mentioned apparatus main unit is an ink jet record apparatus 12, and a print head 13 of a liquid ejection head is disposed movably along a platen not shown.

The ink jet record apparatus 12 is at one side front with a plurality of case set sections 14 as partitions, and a pair of guide members 7 and 7 shown in FIG. 2 is attached to each of the case set sections 14.

A supple needle 15 is placed at the depth of each of the case set sections 14 and is connected to the print head 13 via a supply tube 16. When the ink storage bag 1 is set in the case set section 14 with the ink storage bag 1 housed in the cartridge case 5, the supply needle 15 pierces the ink supply port 4 of the ink storage bag 1 and is inserted into the bag main body 2. In this state, as the print operation of the print head 13 is performed, ink in the ink storage bag 1 is supplied to the print head 13 via the supply needle 15 and the supply tube 16 for printing on record paper P.

A storage device 17 of storage means is fixed to the hermetical seal superposition portion 3 for making it possible to externally read and write data of the ink color, the ink storage capacity, the ink consumption amount, etc. The portion wherein a contact connected to the storage section of the storage device 17 is placed is positioned as an "interface section" as described later. As for the storage device 17, particularly a semiconductor storage device such as EEPROM is formed as the storage section on the back of a circuit board and the contact connected to the semiconductor storage device for coming in contact with a contact of the apparatus main unit is formed on the surface of the circuit board.

As a method of attaching the storage device 17 to the bag main body 2, the storage device 17 is attached via an attachment member 18 made of a synthetic resin. The attachment member 18 is made up of a first attachment member 19 and a second attachment member 20 combined therewith. The first attachment member 19 has a base plate 21 formed with a pedestal part 22 and a dent part 23 into which the storage device 17 is fitted is provided on the lower face of the pedestal part 22. The dent part 23 is provided with a projection 25 fitted into an attachment hole 24 of the storage device 17. The projection 25 is passed through the attachment hole 24 at the same time as the storage device 17 is fitted into the dent part 23, and the part of the projection 25 projected from the attachment hole 24 is thermally caulked. Therefore, the storage device 17 is fixed to the pedestal part 22 according to the thermal caulking technique. Alternatively, the storage device 17 may be fixed with an adhesive. As the storage device 17 is thus fitted into the dent part 23 for attachment, the attachment position of the storage device 17 becomes precise and the attachment state also becomes stable.

Figure 5:
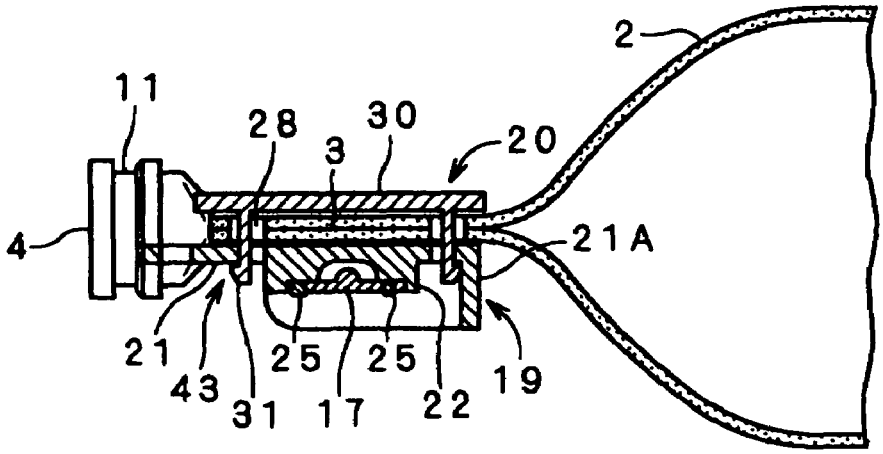
FIG. 5 is a sectional view to show a state in which the attachment member is attached to a bag main body.

A positioning hole 26 is made in an end part of the base plate 21; on the other hand, two engagement holes 27 are made in the proximity of the pedestal part 22. Through holes 28 are made in the parts of the hermetical seal superposition portion 3 matching the engagement holes 27, and engagement legs 29 of passage members of the second attachment member 20 are fitted into the engagement holes 27 through the through holes 28. Each of the engagement legs 29 is projected from a plate material 30 and a hook part 31 provided at the tip of the engagement leg 29 passes through the engagement hole 27 and is caught in the periphery of the engagement hole 27 as shown in FIGS. 5 and 6. Since the engagement leg 29 is given pretension so as to elastically spread left and right, when the hook part 31 passes through the engagement hole 27, the engagement leg 29 is crimped onto the inner face of the engagement hole 27, whereby the first and second attachment members 19 and 20 are put into one piece.

To make it possible to adjust the relative position between the bag main body 2 and the storage device 17 attached as described above, the thickness of the engagement leg 29 is set smaller than the size of the through hole 28. In doing so, when a positioning member (pin) on the cartridge case 5 side described later is fitted into the positioning hole 26, the position of the storage device 17, particularly the position of an electrode of the interface section can be shifted as desired in a predetermined range for precise match with the positioning member without being affected by the bag main body 2.

Two positioning pins 33 are projected in an integrally upright state from a bottom plate 32 of the cartridge case 5, and a data transfer section 34 is placed just in the proximity of the positioning pins. In the data transfer section 34, a conduction member 37 to which a plurality of contacts 36 are attached is fixed onto a pedestal projection 35 molded like the positioning pin 33. The spacing dimension between the positioning pin 33 and the conduction member 37 is substantially the same as the spacing dimension between the positioning hole 26 and the storage device 17, as shown in FIG. 6.

When the bag main body 2 is housed in the cartridge case 5, while the flexible bag main body 2 to which the mass of the ink is added is entered in the cartridge case 5, the positioning hole 26 of the attachment member 18 is matched with the positioning pin 33. That is, as the first attachment member 19 is moved down, the positioning pin 33 pierces the positioning hole 26 relatively, whereby the relative position between the storage device 17 held on the first attachment member 19 and the data transfer section 34 is set. A contact 38 of the storage device 17 (see FIG. 7) comes in precise contact with the contact 36 of the conduction member 37 for reliably conducting data transfer.

In the attachment work of the bag main body 2, the inside of the positioning hole 26 and the positioning pin 33 are matched in a substantially coaxial state and at this time, the engagement leg 29 moves relatively in the through hole 28 and the relative position between the storage device 17 and the conduction member 37 is set correctly. A conduction line 40 connected to the contacts 36 is connected to a controller (not shown) of the ink jet record apparatus 12 through conduction contact of conduction terminals 41 and 42.

Figure 4:
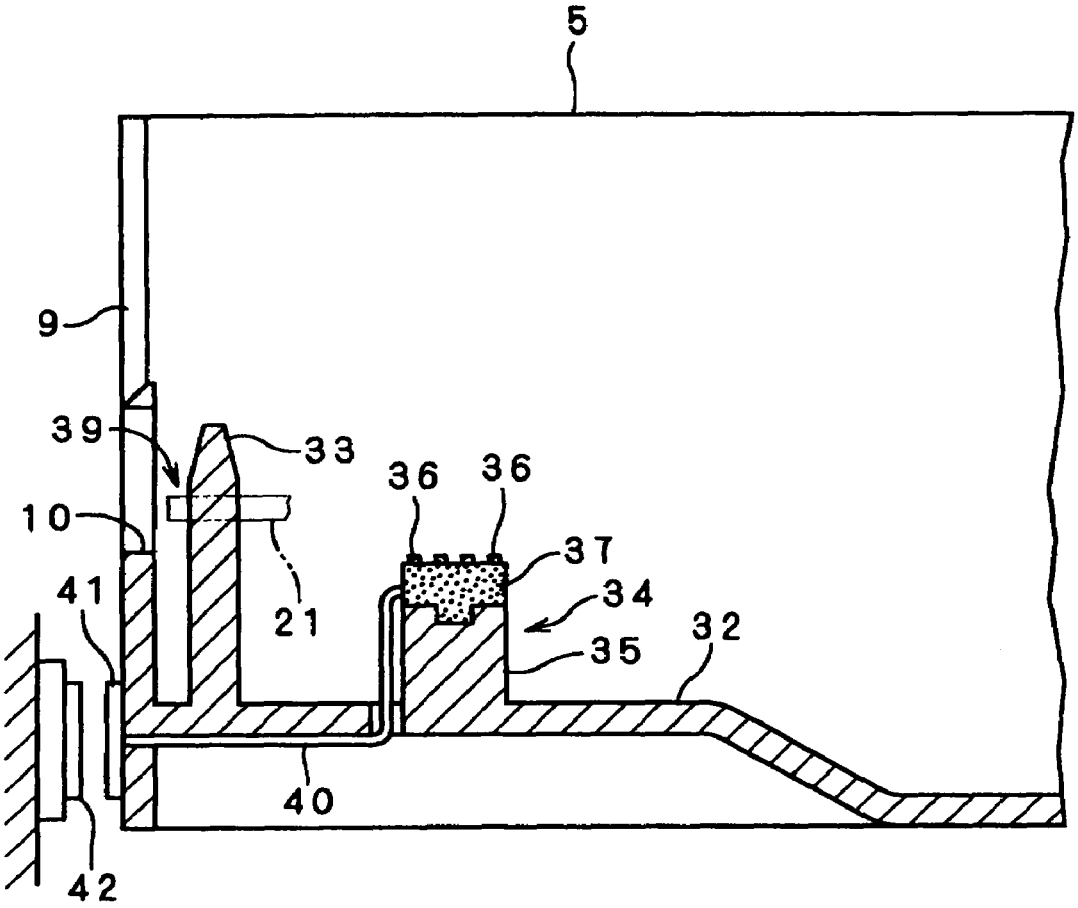
FIG. 4 is a sectional view to show a data transfer section.

The positioning hole 26 and the positioning pin 33 as described above make up a retaining section 39 (see FIG. 4) for setting the relative position between the cartridge case 5 and the attachment member 18. The retaining section 39 makes possible reliable data transfer as mentioned above. An easily detachable structure is adopted for the retaining section 39 like the fit relationship between the positioning hole 26 and the positioning pin 33, so that replacement work of the ink storage bag 1 is simplified. That is, when the user gets only a new ink storage bag 1 for replacement, he or she can easily remove the used ink storage bag 1 from the cartridge case 5 and insert the new ink storage bag 1 into the cartridge case 5; it is also favorable to sales and distribution of the ink storage bag 1.

As described above, the attachment member 18 has the structure displaceable relatively to the bag main body 2, forming position correction means 43. This position correction means 43 specifically is made up of the first attachment member 19, the second attachment member 20, the large through holes 28 made in the hermetical seal superposition portion 3, the engagement legs 29 smaller than the size of the through holes 28, and the like in combination. Therefore, the attachment member 18 serves as a kind of intermediate member, namely, a base member, disposed between a part of the bag main body 2 and the storage device 17 and moreover can move relatively to the bag main body 2, so that a move of the storage device 17 can be made smoothly based on the attachment member 18 and the relative positional relationship between the storage device 17 and the data transfer section 34 can be set precisely.

Figure 7:
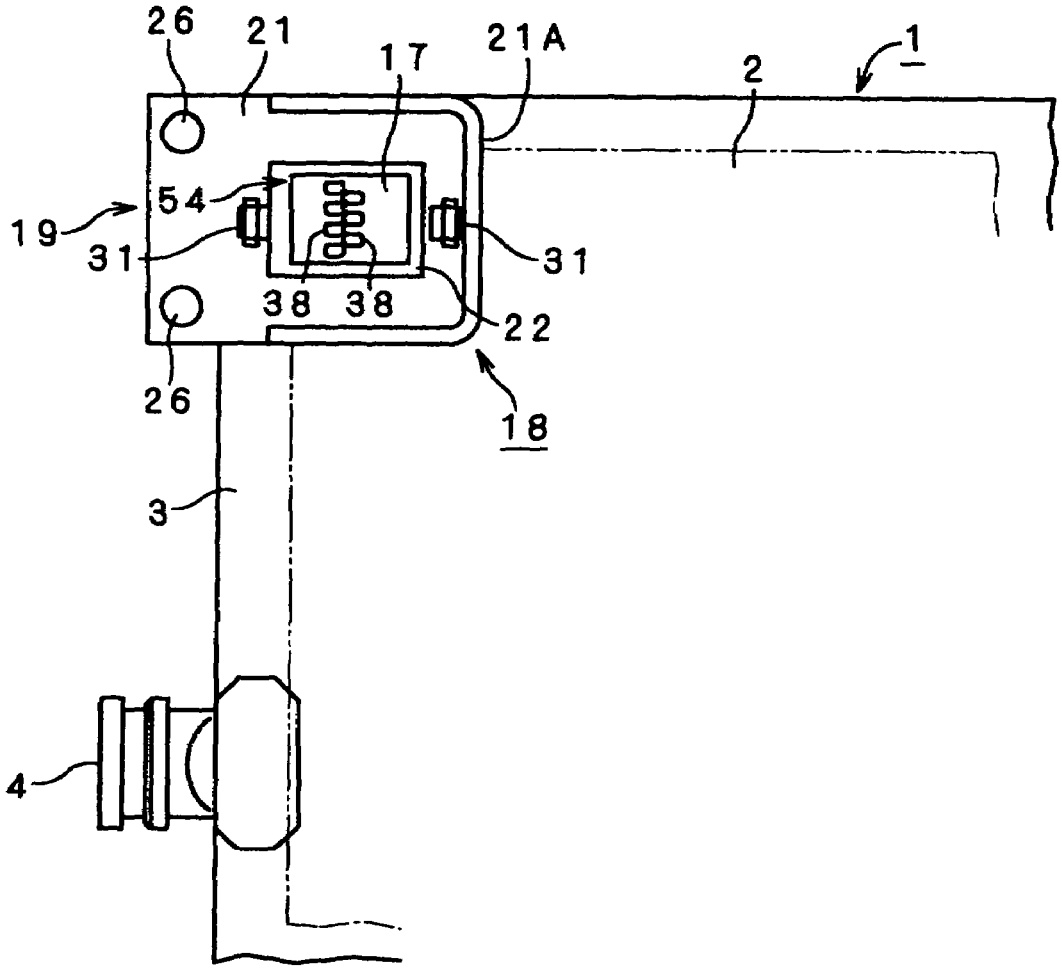
FIG. 7 is a drawing of the attachment member viewed from below.

As shown in FIGS. 2 and 7, the attachment member 18 of the storage device 17 is placed at a corner of the ink storage bag 1, namely, in the proximity of an end part and is also brought close to the ink supply port 4. In doing so, the storage device 17 can be placed without hindering the ink storage capacity of the bag main body 2; it is favorable to ensuring the ink storage capability as the ink storage bag 1 and it is also favorable to positioning the electrode of the storage device 17. The data transfer section 34 corresponding to the storage device 17 can be placed to the end part of the cartridge case 5, so that the volume of the cartridge case 5 can be provided large.

Since the ink supply port 4 and the storage device 17 can be placed collectively on one side of the ink bag as shown in FIG. 7, the ink supply port 4 and the storage device 17 can be placed separately from the liquid storage capacity portion of the ink storage bag 1 and it is made possible to enlarge the liquid storage capacity as much as possible. Further, since making the ink supply port 4 communicate with the print head 13 side and bringing the storage device 17 into conduction with the data transfer section 34 can be performed in a proximity state, when the cartridge case 5 is mounted in an insertion mode, the ink communicating and data signal transfer described above can be performed at the back of the cartridge case 5 and the organization of the cartridge case and the apparatus main unit is enhanced. That is, the attachment member 18 holding the storage device 17 and the ink supply port 4 are placed at the back of the cartridge case 5, so that the advantages as described above can be provided.

Since the storage device 17 is placed in the hermetical seal superposition portion 3, the storage device 17 is attached to the hermetical seal superposition portion 3 having higher rigidity than the sheet material portion touching ink and the attachment stability of the storage device 17 can be enhanced as much as possible.

According to the described configuration, the storage device 17 attached to a part of the bag main body 2 is paced in a state in which it can be displaced relatively to the bag main body 2, and the position adjustment function based on the relative displacement is provided for making it possible to transfer data between the data transfer section 34 and the storage device 17. Therefore, even with the bag main body 2 made of flexible sheet material high in deformability, the storage device 17 can be moved to an appropriate position by the position correction means 43 for setting the correct relative position between the interface section of the storage device 17 and the data transfer section 34. Accordingly, when the ink storage bag 1 is entered in the cartridge case 5, immediately the relative position between the interface section of the storage device 17 and the data transfer section 34 can be set, various pieces of data of the ink consumption amount, etc., concerning the ink attributes can be transferred reliably, and the function of the ink storage bag 1 can be provided precisely.

Figure 8:
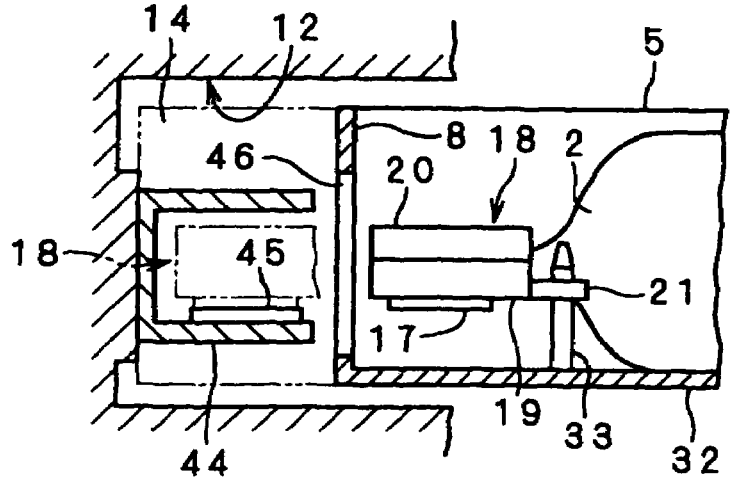
FIG. 8 is a sectional view to show a second embodiment of liquid storage bag of the invention.

FIG. 8 shows a second embodiment of liquid storage bag of the invention. In the embodiment, a data transfer section 34 is placed in an ink jet record apparatus 12, namely, an apparatus main unit. A support case 44 is fixed to the back of the above-mentioned case set section 14 and a conduction member 45 including a contact (not shown) is fixed at the bottom. On the other hand, a communicating port 46 is made in a back wall plate 8 of a cartridge case 5. Other parts are similar to those of the embodiment described above and similar parts are denoted by the same reference numerals.

In the above-described configuration, when the cartridge case 5 is inserted, an attachment section 18 enters the support case 44 as indicated by the chain double-dashed line in the figure and a storage device 17 and the conduction member 45 are brought into conductive contact with each other. In addition, similar advantages to those of the above-described embodiment are provided.

Figure 9:
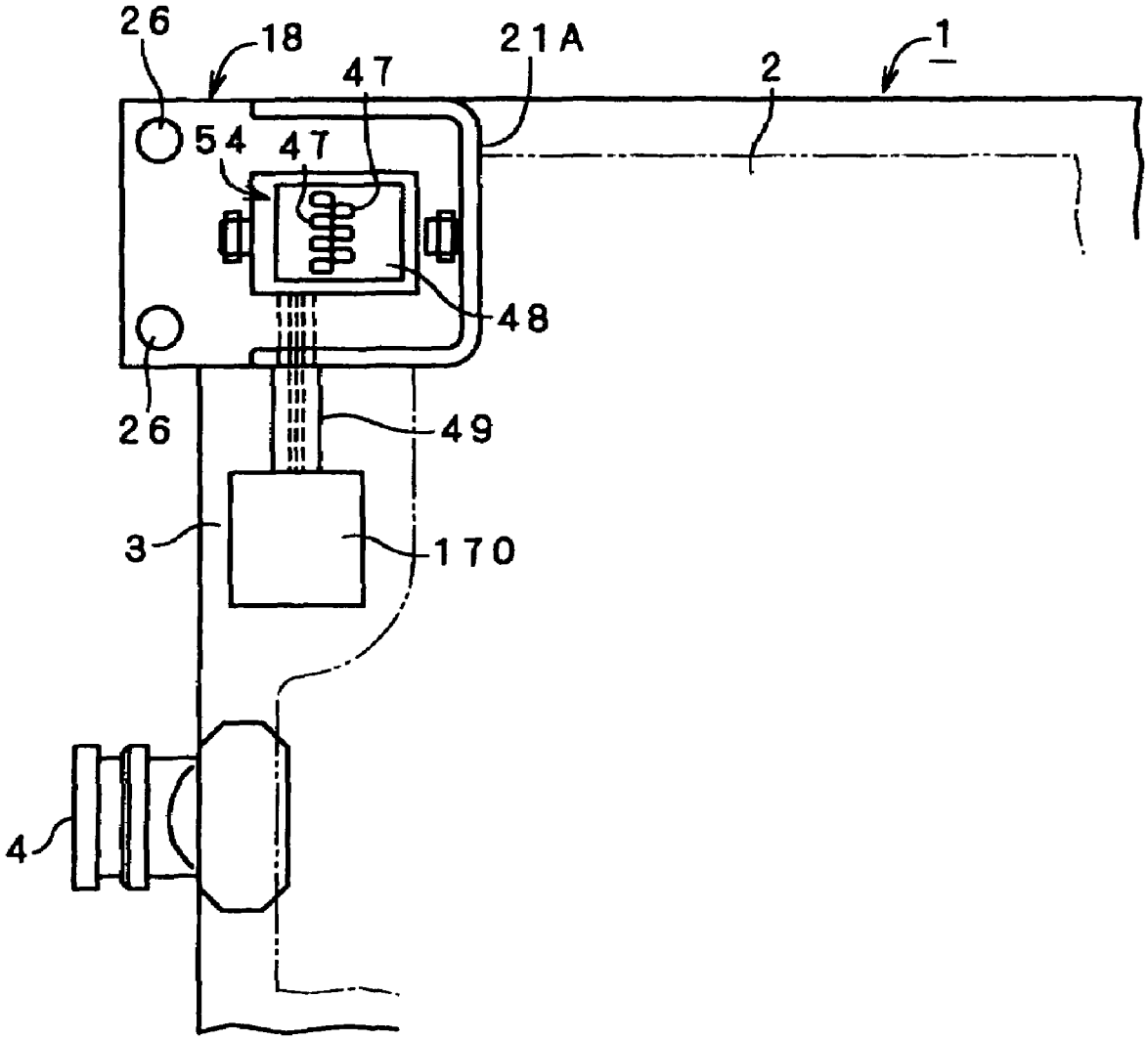
FIG. 9 is a drawing to show a third embodiment of liquid storage bag of the invention.

Another embodiment will be discussed with FIG. 9. In a third embodiment shown in FIG. 9, a storage section 170 of a storage device 17 is fixed to a hermetical seal superposition portion 3 with an adhesive, etc., and on the other hand, a base plate 48 formed with contacts 47 is attached to the above-described dent part 23 of a first attachment member 19. A conduction line 49 formed of FPC, etc., from the storage section 170 including semiconductor storage device is connected to the contacts 47 of the base plate 48. In the embodiment, the contacts 47 corresponding to contacts 36 of a data transfer section 34 are placed on the base plate 48 of a separate member from the storage section 170 including the semiconductor storage device, as described later. Therefore, the base plate 48 formed with the contacts 47 serves as an "interface section." Other parts are similar to those of each embodiment described above and similar parts are denoted by the same reference numerals.

In the above-described configuration, when an ink storage bag 1 is placed in a cartridge case 5, a positioning pin 33 formed on the cartridge case engages with a positioning hole 26 of an attachment section 18 on which the base plate 48 is mounted and the contacts 47 of the base plate 48 match the contacts 36 of a conduction member 37 placed in the cartridge case 5, making it possible to transfer data concerning various conditions of ink. According to the configuration, the storage section 170 is placed at an optimum position for the storage section 170 and the base plate 48 connected to the storage section 170 corresponds to the data transfer section 34, so that the function of the storage section 170 can be provided at the best placement position. If the position of the data transfer section 34 is changed, only the base plate 48 needs to be made to correspond to the data transfer section 34, so that the effect on the storage section 170 can be minimized.

In the above-described embodiments, the storage device 17 has been described as two types, one wherein the circuit board is formed with the semiconductor storage device and the contacts and the other wherein the storage section including the semiconductor storage device and the base plate formed with the contacts are connected by FPC. In the two types, it is an important object to establish the precise transfer relationship with the data transfer section 34 by the above-described "position correction means 43" and therefore conceptually the portion wherein the contacts are formed is called as "interface section."

Figure 10:
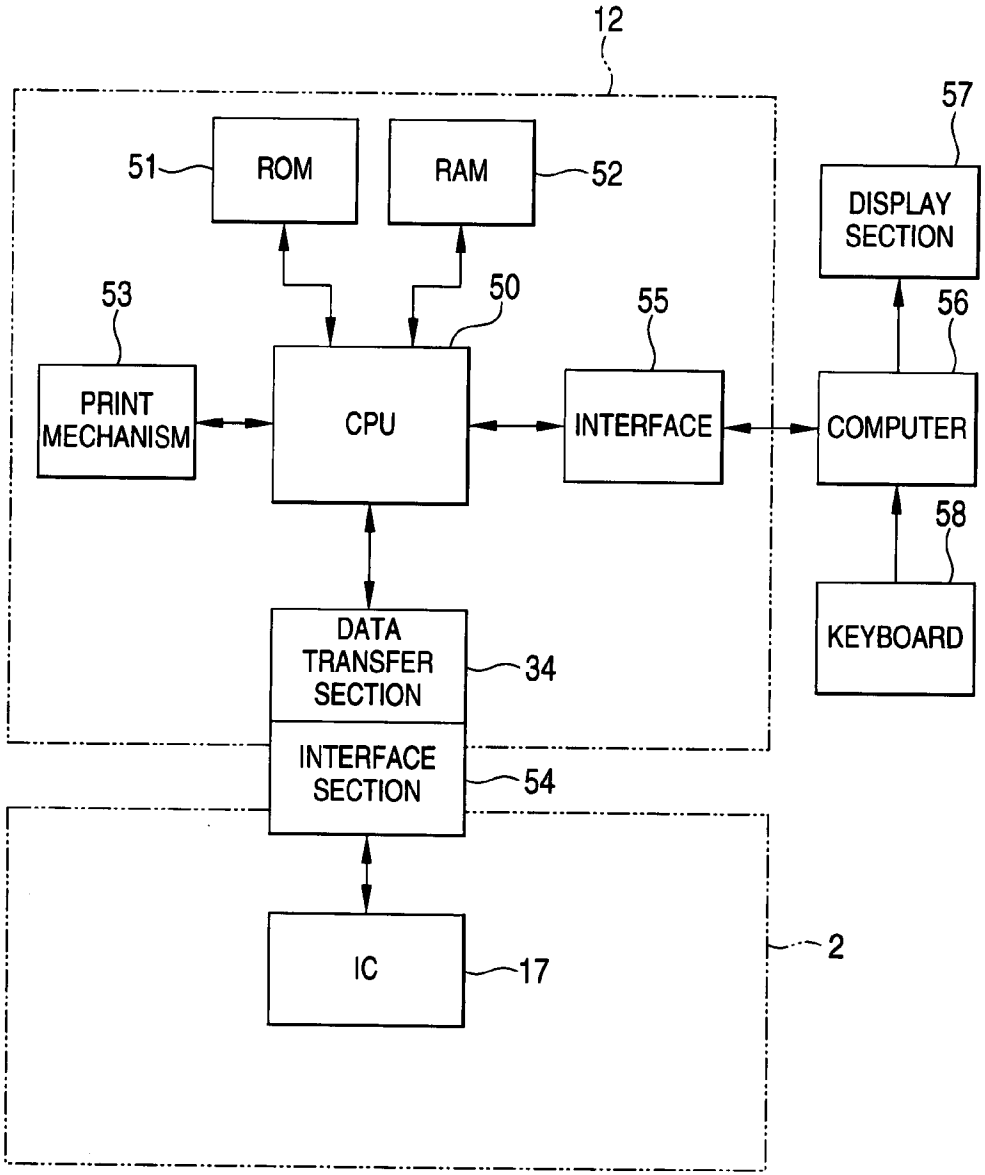
FIG. 10 is a block diagram to show the circuit configuration of an apparatus main unit.
Figure 11:
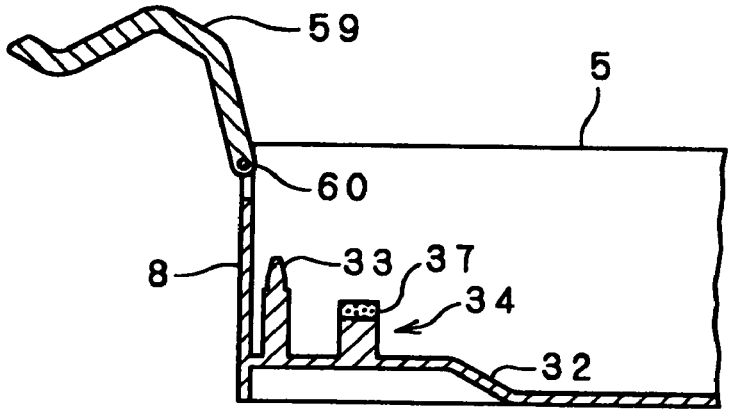
FIG. 11 is a sectional view to show a first embodiment of liquid ejection apparatus of the invention.
Figure 12:
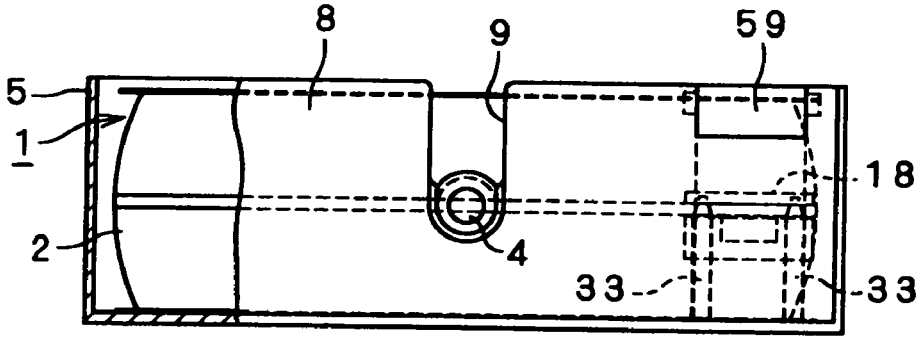
FIG. 12 is a front view of the liquid ejection apparatus in FIG. 11.

Next, the circuit configuration of apparatus main unit 12 in which the described ink storage bag 1 is placed will be discussed according to FIG. 10. The ink jet record apparatus 12 includes a central processing unit (CPU) 50 for controlling the whole operation of the record apparatus 12, and read-only memory (ROM) 51 storing programs and random access memory (RAM) 52 for storing working data, etc., are connected to the CPU 50. A print mechanism 53 containing the above-mentioned print head 13 is connected to the CPU 50, and an operation signal is output to the print mechanism 53. Data transfer section 34 is connected to the CPU 50, and ink attribute data is input/output from/to the data transfer section 34.

The above-mentioned interface section 54 matches the data transfer section 34 so as to establish data transfer, and the storage device 17 attached to the bag main unit 2 is connected to the interface section 54 so that the information stored in the storage device is read and written.

Further, an external computer 56 is connected to the CPU 50 in the record apparatus 12 through an interface 55 and print data, an alarm display signal, and the like are transferred between the computer 56 and the CPU 50. A display section 57 such as a display is connected to the computer 56 and when an alarm display signal is output from the CPU 50 to the computer 56, an alarm message is displayed on the display section 57. A keyboard 58 is connected to the computer 56 for entering various pieces of data through the keyboard 58.

To use the ink storage bag 1 in the above-described embodiment as one component of the ink jet record apparatus 12, the interface section 54 attached to a part of the bag main unit 2 is placed in a state in which it can be displaced relatively to the bag main unit 2, and the position adjustment function based on the relative displacement is provided for making it possible to transfer data between the data transfer section 34 and the storage device 17 through the interface section 54. Therefore, even with the bag main body 2 made of flexible sheet material high in deformability, the interface section 54 can be moved to an appropriate position by the above-mentioned position correction means 43 for setting the correct relative position between the interface section 54 and the data transfer section 34. Accordingly, when the ink storage bag 1 is entered in the cartridge case 5, the relative position between the interface section 54 and the data transfer section 34 can be set, various pieces of data of the ink consumption amount, etc., concerning the ink attributes can be transferred reliably, and the function of the ink jet record apparatus 12 can be provided precisely.

Figure 13:
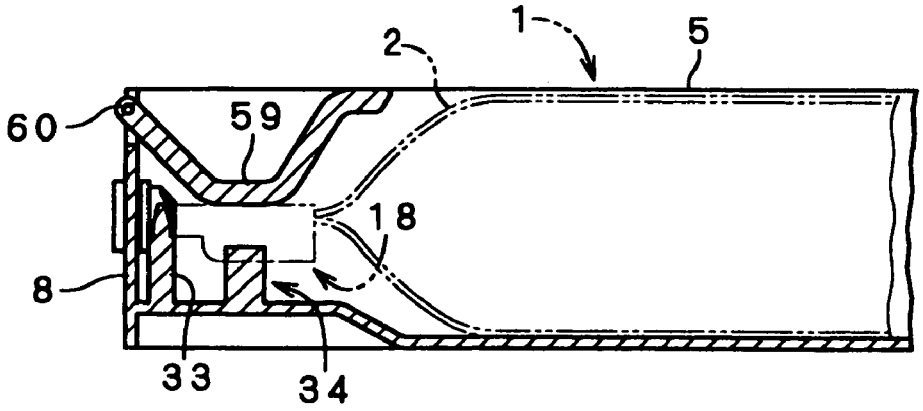
FIG. 13 is a sectional view to show the operation state of a press member in FIG. 11.

FIGS. 11 to 15 show the structure of a part of liquid ejection apparatus of the invention, a first embodiment of liquid ejection apparatus. This embodiment provides a press mechanism for maintaining the positioning state of a storage device 17, a base plate 48, etc., namely, an interface section 54 and a data transfer section 34. A rotation press member 59 is pivotally attached to a back wall plate 8 of a cartridge case 5 by a shaft 60; the press member 59 is abutted against the top of an attachment member 18 as shown in FIG. 13 to provide a press function.

Figure 14:
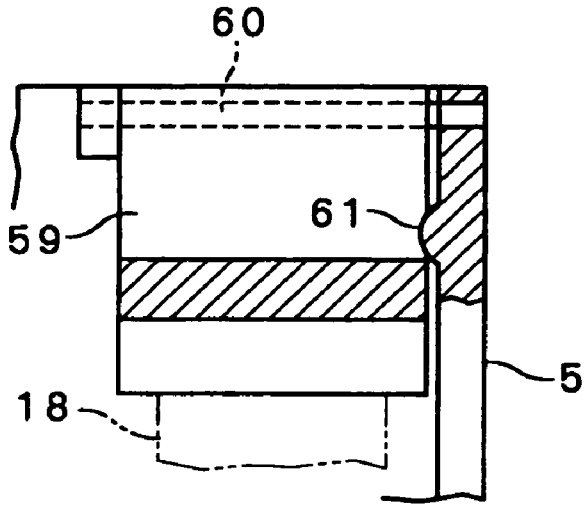
FIG. 14 is a fragmentary sectional view of the press member in FIG. 11.

As shown in FIG. 14, a moderate-shaped projection 61 is formed on the inner face of the cartridge case 5 so that the press member 59 does not freely return. As shown in FIG. 14, the state in which the press member 59 climbs over the projection 61 is the return prevention state of the press member 59. To release pressing of the press member 59, the press member 59 is made to climb over the projection 61 in the opposite direction with a hand to open the press member 59.

Figure 15:
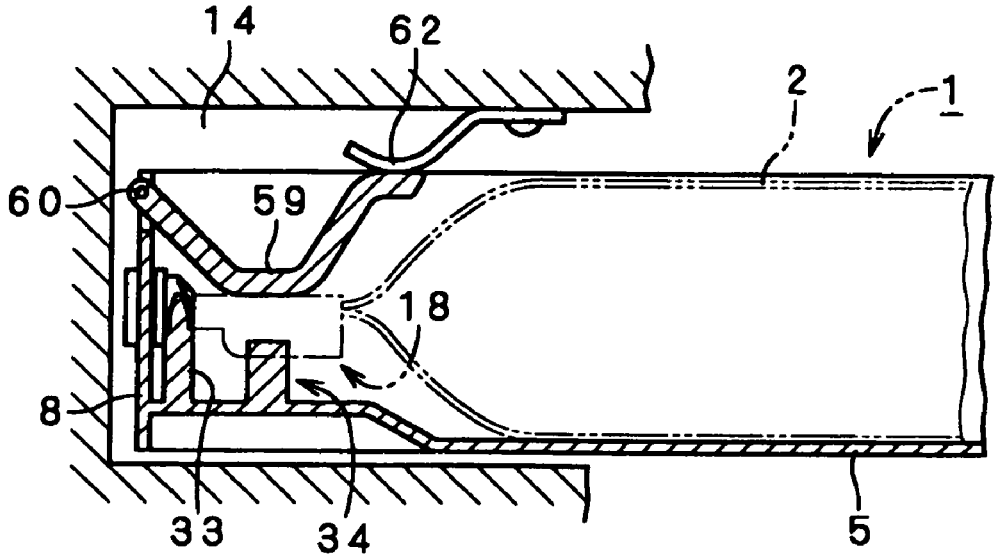
FIG. 15 is a sectional view to show a modification of press member.

A member shown in FIG. 15 provides a press function using displacement when the cartridge 15 is placed in the apparatus main unit 12; when press member 59 enters, press action is executed with a plate spring 62 shaped like a circular arc, fixed to the case set section 14. Other parts are similar to those of each embodiment described above and similar parts are denoted by the same reference numerals.

According to each configuration described above, conductivity between the interface section 54 and the data transfer section 34 is always ensured normally, so that data transfer becomes reliable and the function as the highly reliable liquid storage bag can be provided. Placement of the cartridge case 5 and the press function of the press member 59 are executed automatically in conjunction with each other, so that the press member 59 can be operated reliably and labor of the user can be lessened effectively.

In addition, similar advantages to those of each embodiment described above are provided.

Since the data transfer section 34 is placed in the cartridge case 5, when the bag main body 2 is housed in the cartridge case 5, immediately the interface section 54 attached to the bag main body 2 matches the data transfer section 34 placed in the cartridge case 5, making possible data transfer. Thus, the ease of use of the cartridge case 5 in the ink jet record apparatus 12 is enhanced.

Figure 3:
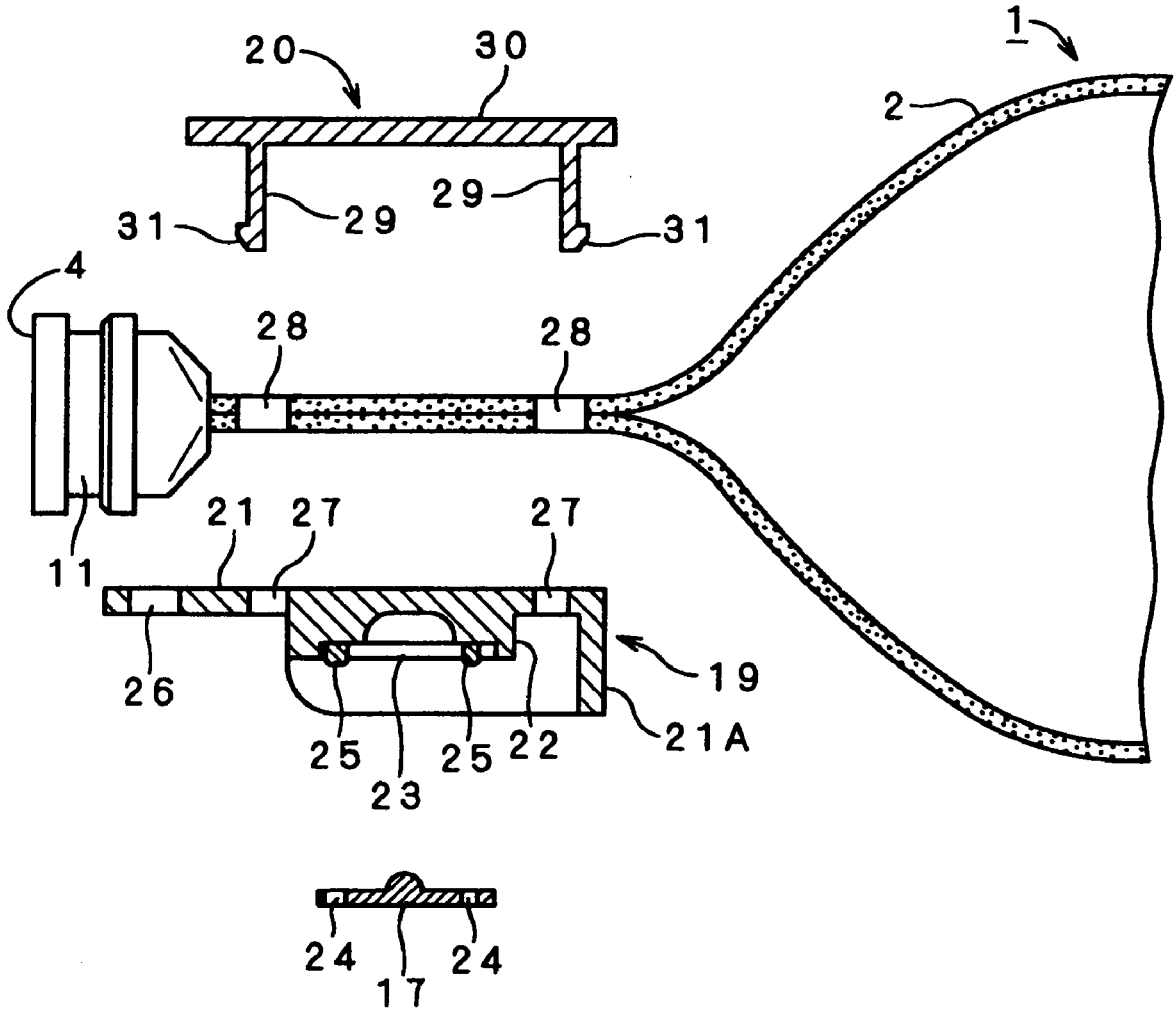
FIG. 3 is an exploded sectional view to show an attachment member.

A protective wall 21A is integral with the first attachment member 19 of the attachment member 18 along the periphery of the base plate 21. The protective wall 21A is almost angular-U shaped open toward the end part of the bag main body 2 and surrounds the interface section 54. If the sheet material of the bag main body 2 becomes wrinkled for some cause, the protective wall 21A prevents the wrinkle from coming in contact with the conductive portion of the interface section 54 and the data transfer section 34, and is effective for ensuring establishment of data transfer. The height of the protective wall 21A is made sufficiently high as shown in FIGS. 3, 5, 6, etc., whereby if the bag main body 2 is handled in an offhand manner or is dropped carelessly, the contacts 38 and 47 of the interface section 54 can be protected.

Further, the two positioning pins 33 are provided and are inserted into the two positioning holes 26, so that the attachment member 18 can be prevented from rotating so as to shift in the plane direction of the bottom plate 32 of the cartridge case 5. Thus, the plurality of positioning pins 33 and positioning holes 26 make it possible to set the precise relative position between the cartridge case 5 and the attachment member 18. In the embodiment, the positioning holes 26 are placed on both sides in the arrangement direction of the contacts 38, 47.

In the description of each embodiment, the section for making possible data transfer to and from the data transfer section 34 by electric conduction of the contacts is illustrated as the interface section 54, but the scope of the invention is not limited to it; a section containing a coil (antenna) for making possible data transfer to and from the data transfer section 34 in a noncontact manner is also included as the interface section 54. In this case, relative positioning between the antenna placed in the interface section 54 and an antenna placed in the data transfer section 34 is carried out reliably, the reception and transmission correspondence between the antennas is established precisely, and reliable data transfer is realized. Other points are similar to each embodiment described above and similar advantages are provided.

Further, the position correction means in the embodiment is described in the mode in which the engagement legs 29 of the attachment member 18 are inserted into the through holes 28 formed in the ink bag, but may be a mode in which the interface section can be moved relatively to the ink bag.

For example, the attachment member may be a fixed part intimately fixed to the ink bag and a storage device attachment part (board attachment part) placed movably relative to the fixed part. As a method of making the storage device attachment part movable relative to the fixed part, the fixed part and the storage device attachment part may be fixed by an elastic member or the storage device attachment part may be fitted into a recess part of the fixed part so as to be able to slide in a plane manner. In both cases, the positioning holes 26 are formed in the movable storage device attachment part.

The above-described embodiments are intended for the ink jet record apparatus, but the liquid storage bag and the liquid ejection apparatus according to the invention are intended not only for ink for the ink jet record apparatus, but also for a color material ejection head of a color filter manufacturing apparatus for manufacturing color filters of a liquid crystal display, an electrode material (conductive paste) ejection head for forming electrodes of an organic EL display, FED (face light emission display), etc., a biological organic substance ejection head of a biochip manufacturing apparatus for manufacturing biochips, a specimen ejection head as a precision pipette, etc.

As described above, according to the liquid storage bag and the liquid ejection apparatus according to the invention, the interface section attached to a part of the bag main unit is placed in a state in which it can be displaced relatively to the bag main unit, and the position adjustment function based on the relative displacement is provided for making it possible to transfer data between the data transfer section and the storage means through the interface section. Therefore, even with the bag main body made of flexible sheet material high in deformability, the interface section can be moved to an appropriate position by the above-mentioned position correction means for setting the correct relative position between the interface section and the data transfer section. Accordingly, when the ink storage bag is entered in the cartridge case, immediately the relative position between the interface section and the data transfer section can be set, various pieces of data of the liquid consumption amount, etc., concerning the liquid attributes can be transferred reliably, and the functions of the liquid storage bag and the liquid ejection apparatus can be provided precisely.

INDUSTRIAL APPLICABILITY

The invention can be used for a liquid storage bag storing liquid and including storage means and a liquid ejection apparatus housing the liquid storage bag, particularly an ink storage bag and an ink jet record apparatus.

The invention claimed is:

1. A liquid storage bag for use with a liquid ejection apparatus, comprising:

a flexible bag main body to store a liquid;

a liquid supply port communicating with an inside of the bag main body;

a storage device attached to the bag main body for storing information concerning the liquid;

an interface section connected to the storage device for transferring information to and from the liquid ejection apparatus; and an attachment member formed with the interface section and capable of moving a position of the interface section with respect to the bag main body.

2. The liquid storage bag as claimed in claim 1, wherein the flexible bag main body is housed in a cartridge case that is received in the liquid ejection apparatus, and the attachment member is provided with a positioning part to set a relative position between the cartridge case and the attachment member as the positioning part engages a part of the cartridge case.

3. The liquid storage bag as claimed in claim 2, wherein the attachment member includes a first attachment member formed with the interface section and provided with the positioning part and a second attachment member passing through a through hole made in a hermetical seal superposition portion of the bag main body for attaching the first attachment member to the hermetical seal superposition portion and the thickness of a passage member of the second attachment member passing through the through hole is smaller than a size of the through hole.

4. The liquid storage bag as claimed in claim 1, wherein the interface section is placed in by an end part of the bag main body.

5. The liquid storage bag as claimed in claim 1, wherein the interface section is placed at a hermetical seal superposition portion of the sheet material forming the bag main body.

6. The liquid storage bag as claimed in claim 1, wherein the interface section is placed by the liquid supply port.

7. The liquid storage bag as claimed in claim 1, wherein the interface section comprises a contact capable of transferring data to and from the data transfer section by electric conduction.

8. The liquid storage bag as claimed in claim 1, wherein the interface section can transfer data to and from the data transfer section in a noncontact manner.

9. The liquid storage bag as claimed in claim 1, wherein the interface section includes a plurality of connection electrodes.

10. The liquid storage bag as claimed in claim 9, wherein the attachment member installs a circuit board formed with an electrode on the surface and provided with a storage section on the back and is attached movably with respect to the bag main body.

11. The liquid storage bag as claimed in claim 10, wherein the attachment member is formed with a positioning part engaging a positioning member formed in a housing section for housing said liquid storage bag.

12. The liquid storage bag as claimed in claim 1, wherein the interface section includes an antenna for conducting communications in a noncontact manner.

13. A liquid ejection apparatus comprising a liquid storage bag including:

a flexible bag main body storing a liquid;

a liquid supply port communicating with an inside of the bag main body;

a storage device attached to the bag main body for storing information concerning the liquid;

an interface section connected to the storage device for transferring information to and from the liquid ejection apparatus; and an attachment member formed with the interface section and capable of moving a position of the interface section with respect to the bag main body, wherein the liquid supplied from the liquid storage bag is ejected from the liquid ejection head.

14. The liquid ejection apparatus as claimed in claim 13, further comprising a press member for maintaining the positioning state of the interface section and the data transfer section.

15. The liquid ejection apparatus as claimed in claim 14, wherein the press member provides a press function in response to displacement when the cartridge case is placed in the apparatus main unit.

16. The liquid ejection apparatus as claimed in claim 13, wherein the data transfer section is placed in the cartridge case.

* * * * *